US006794621B1

(12) United States Patent
Brown et al.

(10) Patent No.: US 6,794,621 B1
(45) Date of Patent: Sep. 21, 2004

(54) COOK TOP STATUS INDICATOR

(75) Inventors: Simon Denzil Brown, Dunedin (NZ); Graeme Colin Fuller, South Dunedin (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 10/030,863

(22) PCT Filed: Jul. 21, 2000

(86) PCT No.: PCT/NZ00/00133

§ 371 (c)(1),
(2), (4) Date: May 16, 2002

(87) PCT Pub. No.: WO01/07835

PCT Pub. Date: Feb. 1, 2001

(30) Foreign Application Priority Data

Jul. 22, 1999 (NZ) ..... 336874

(51) Int. Cl.[7] ..... H05B 1/02

(52) U.S. Cl. ..... 219/506; 219/502; 219/445.1; 219/497; 219/413

(58) Field of Search ..... 219/494, 497, 219/501, 505, 506, 502, 411–413, 445.1

(56) References Cited

U.S. PATENT DOCUMENTS

| | | | |
|---|---|---|---|
| 5,138,135 | A | 8/1992 | Husslein et al. |
| 5,162,636 | A | 11/1992 | Randolph, Jr. et al. |

FOREIGN PATENT DOCUMENTS

| | | |
|---|---|---|
| DE | 4214509 | 3/1995 |
| GB | 2170002 | 7/1986 |

*Primary Examiner*—Mark Paschall
(74) *Attorney, Agent, or Firm*—Trexler, Bushnell, Giangiorgi, Blackstone & Marr, Ltd.

(57) ABSTRACT

A status indicator (4) for a transparent ceramic glass cook top is disclosed which is able to display a range of colors. Typically such indications are used with red or smoked glass cooktops and are limited to red. The present invention is positioned directly underneath the transparent glass (22) which has an opaque layer (23) on the underside and wherein a portion (24) of the opaque layer has been removed thereby allowing the light source (2) to be visible directly above said cook top. The indicator may be used for a range of functions, including indicating the element is on and also that the heating region is too hot to be safely touched.

10 Claims, 7 Drawing Sheets

COOK TOP STATUS INDICATOR

FIELD OF THE INVENTION

This invention relates to the use of an element status indicator for a ceramic glass cook top.

DESCRIPTION OF RELATED ART

Conventional ceramic glass cook tops generally employ either a dark red or brown ceramic glass top. With red coloured ceramic glass only red light will be permitted to pass. This has meant that in conventional cook tops generally red neon lamps have been used underneath the sheet of glass as indicators for a number of conditions.

In particular it has proven useful to provide indication of whether it is safe to touch the surface of the cook top. The generally accepted "safe" temperature is approximately 50–60° C., above which any such indicator would be lit. In some cases however because all the indicators (for various different conditions eg: dual element) will be red it can be somewhat confusing as to what each indication relates to at a quick glance. In the worst case this may lead to inadvertently placing ones hand or other inappropriate objects onto the cook top when it is hot.

SUMMARY OF THE INVENTION

It is an object of the present invention to provide an element status indicator for a ceramic glass cook top which goes some way to overcoming the abovementioned disadvantages or at least provides the public with a useful choice.

In a first aspect the present invention may broadly be said to consist in a cooktop including at least one heating means beneath a substantially colourless and transparent ceramic glass surface with an opaque layer on sections of the underside thereof and a status indicator, said status indicator comprising:

indication means positioned directly underneath and proximate to said surface wherein said opaque layer is not present directly above said indication means, allowing said indication means to be visible directly above said cook top, and a control means configured to determine the temperature of said surface above said heating means and energise said indication means when said surface above said heating means is above a predetermined temperature and de-energises said indication means when said surface above said heating means is below said predetermined temperature.

Preferably said control means comprises an electric circuit fed from a transformer less supply.

Preferably the colour emitted by said indication means is dependent on whether said heating means is energised.

Preferably said indication means is at least one light emitting diode.

Preferably said control means includes heat sensing means positioned in close proximity to said heating means, the electrical characteristics of which are temperature dependent.

Preferable said heat sensing means is a bimetallic switch.

Alternatively said heating sensing means is a thermistor.

In a further alternative said heating sensing means is a positive temperature coefficient paste coated on the underside of said surface or said opaque layer.

Preferably said predetermined temperature is the maximum temperature for which human skin can safely be exposed to.

Preferably said maximum temperature is 50° C.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the present invention will now be described with reference to the accompanying drawings in which.

DESCRIPTION OF THE PREFERRED EMBODIMENTS

In the preferred form of the present invention an element status indicator is provided on a ceramic glass cook top in order to indicate when the surface of the cook top is safe to touch. The indicators are preferably of the LED variety which provides the ability to use different colours to indicate different conditions. In order that this can be achieved the cook top is of a clear glass variety coated on the underside with a layer of enamel.

Figure 1:
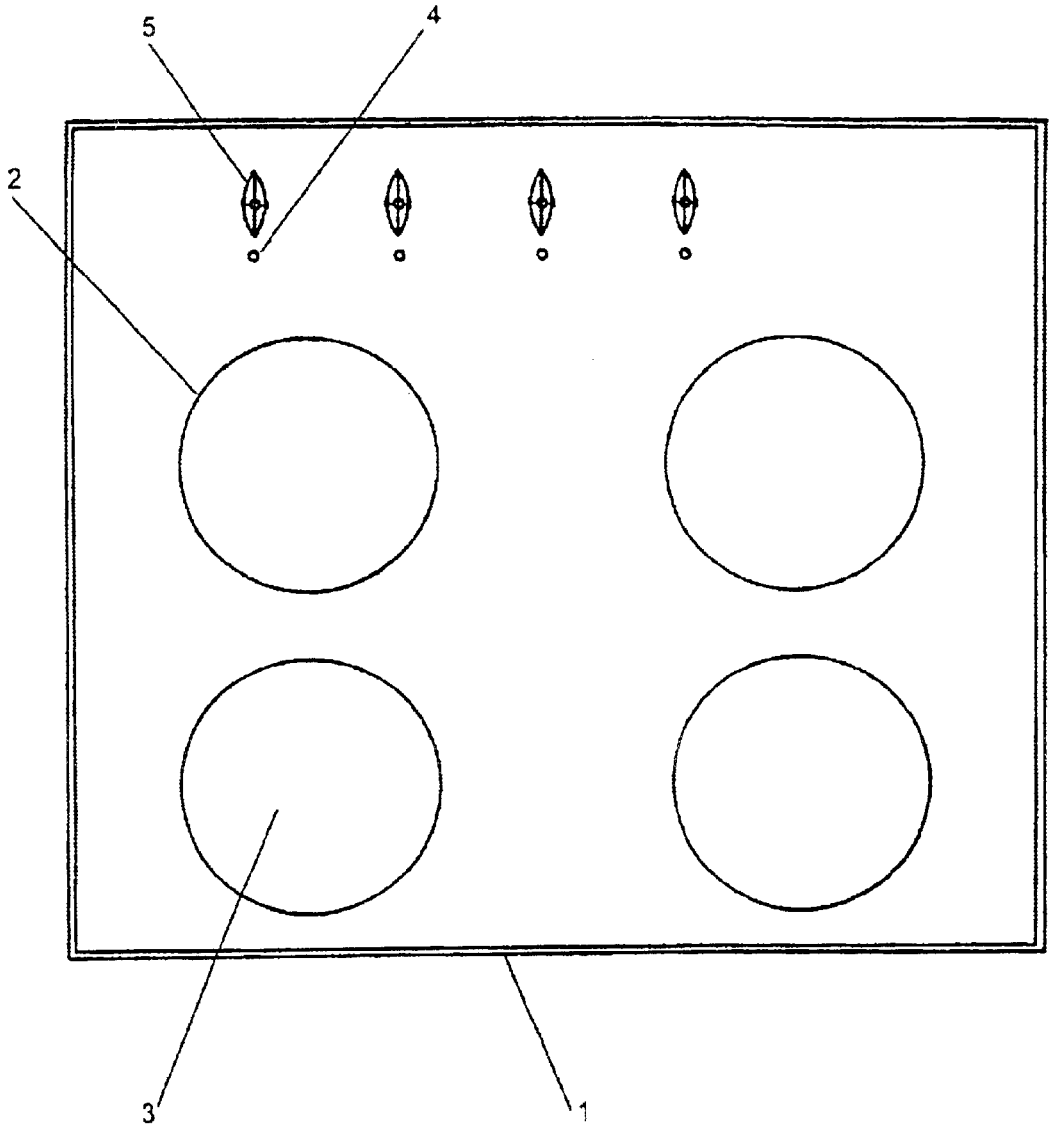
FIG. 1 is a plan view of the cook top.

A glass surface cook top 1, shown in FIG. 1, includes four circular elements 2 as would be typical for a conventional cook top. Generally the elements will be of the radiant ribbon variety, chosen for their quick response and high efficiency. The surface of the cook top 3 above the element 2 will initially be cool but will quickly heat up due to radiation from the element 2 and conduction from the heating vessel (not shown). Once the element 2 is turned off and the heating vessel removed, the thermal inertia of the glass 3 means that it will stay significantly hot for quite some time—up to 15 minutes. Obviously this is not that safe because there will be no visible indication of the surface temperature—if the element 2 is not glowing it would normally be assumed the element 2 is off and the surface 3 therefore cold.

The preferred embodiment of the present invention includes a multicoloured indicator 4 for each element 3. The indicator 4 is positioned beside the control knob 5 for easy reference as to that elements status. Different colours can be used to indicate different conditions eg: orange for element on, red for element too hot to touch. Alternatively the indicators could be positioned separately to mimic the spatial orientation of the respective elements.

The cook top surface in the preferred embodiment is constructed from glass ceramic, e.g. borosilicate, of approximately 4 mm thickness, and clear or "smoky" in appearance (substantively transparent). The top surface is smooth and the rear either smooth or slightly textured, which reduces stress concentrations from scratches preferably resulting in a bending strength greater than 100N/mm$^2$. The overall colour of the panel arises from a ceramic ink which is screened on the rear of the panel. The areas outside the elements 2 are screened with a black or dark colour to make the panel suitably opaque (specifically not to show a colour change from moisture or glue in contact with the lower surface). The area of the ceramic glass above the heated area of the element 2 needs to be able to cope with more arduous conditions eg thermal load of 700° C., class 1 restraint to acid, alkali and water without discolouration. A different (and more limited) palette of colours would be used for this area, to help delineate it from the main area. It is also important that this area is more translucent to enable the element to be seen when glowing (the ability to t radiant energy in the 500–4000 nm range is clearly of prime importance too).

Figure 2:
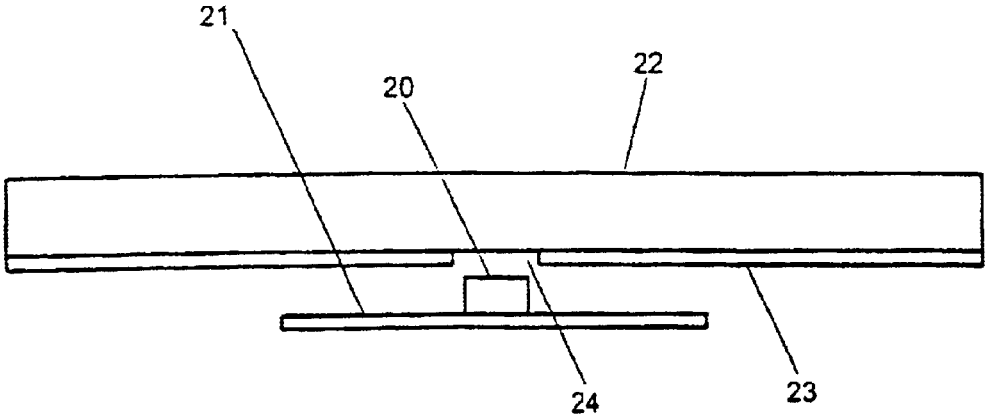
FIG. 2 is a cross section of the cook top using a surface mount LED.
Figure 3:
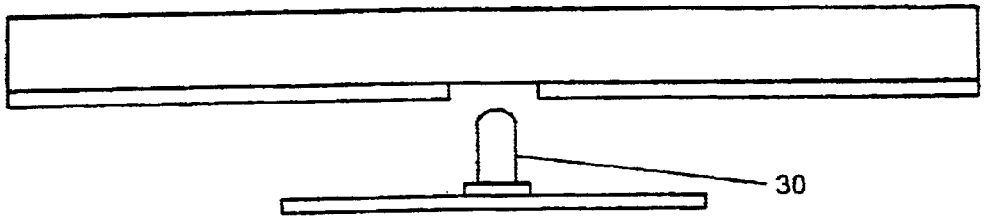
FIG. 3 is a cross section of the cook top using a PCB mounted LED.
Figure 4:
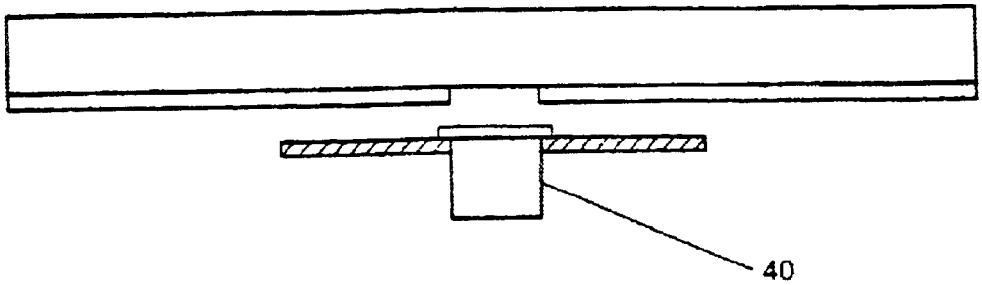
FIG. 4 is a cross section of the cook top using a bezel mounted LED.

The indicator 4, seen in FIG. 1, is preferably a surfaced mounted LED 20, seen from the side in FIG. 2. The LED 20 is mounted on a printed circuit board 21 which might also include provision for touch controls, or a rotary knob to control the elements 2. Directly above the LED 20 the enamel 23 is absent from the underside of the glass 24, to allow the LED 20 to be visible from above. Since the glass is clear this means that any colour of indication can be visible, rather than only red as was conventionally available. In a similar fashion the indicator could be a convention PCB mount LED 30, shown in FIG. 3, or an LED mounted in a bezel 40, shown in FIG. 4.

The indicator maybe controlled by a number of means many of which are known in the art. The preferred embodiment of the present involves a bimetallic switch on the body of the element which closes when the glass surface temperature is above 50° C.

It will be appreciated many other variations would be equally applicable. A thermistor or other types of thermally responsive sensor could also be used in conjunction with an electronically controlled cooktop. Especially where such a cooktop included a microprocessor, such devices would also be used to control the energisation of the elements themselves.

Figure 5:
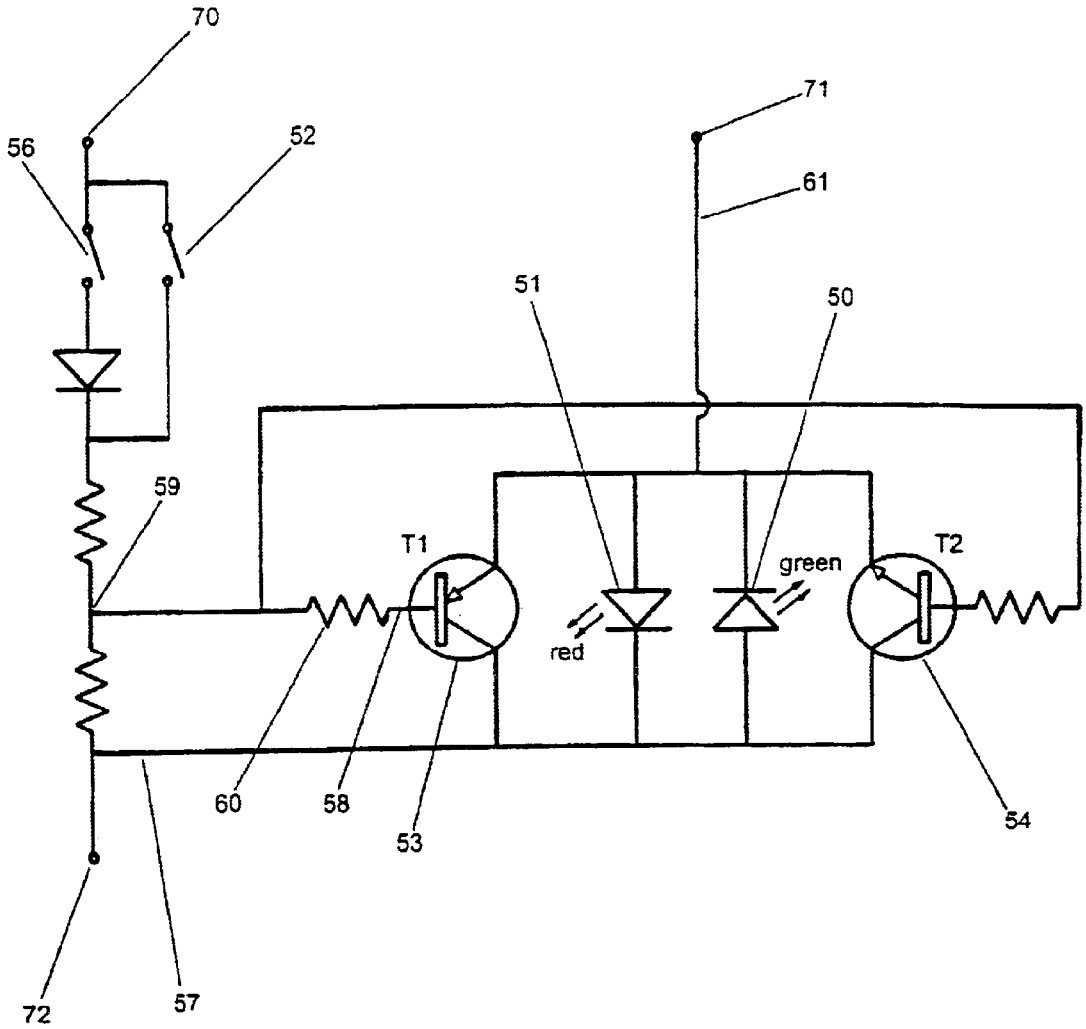
FIG. 5 is a circuit diagram of the control circuit for the element status indicator.

A circuit module is used to control the LEDs for each element, seen in FIG. 5, which emit an orange light when the element is on and a red light when the element is cooling. The orange light is an optical combination or a green LED 50 and a red LED 51. The circuit is more simply analysed in its three modes of operation:

i) element on ii) element cooling and iii) element off

Figure 6:
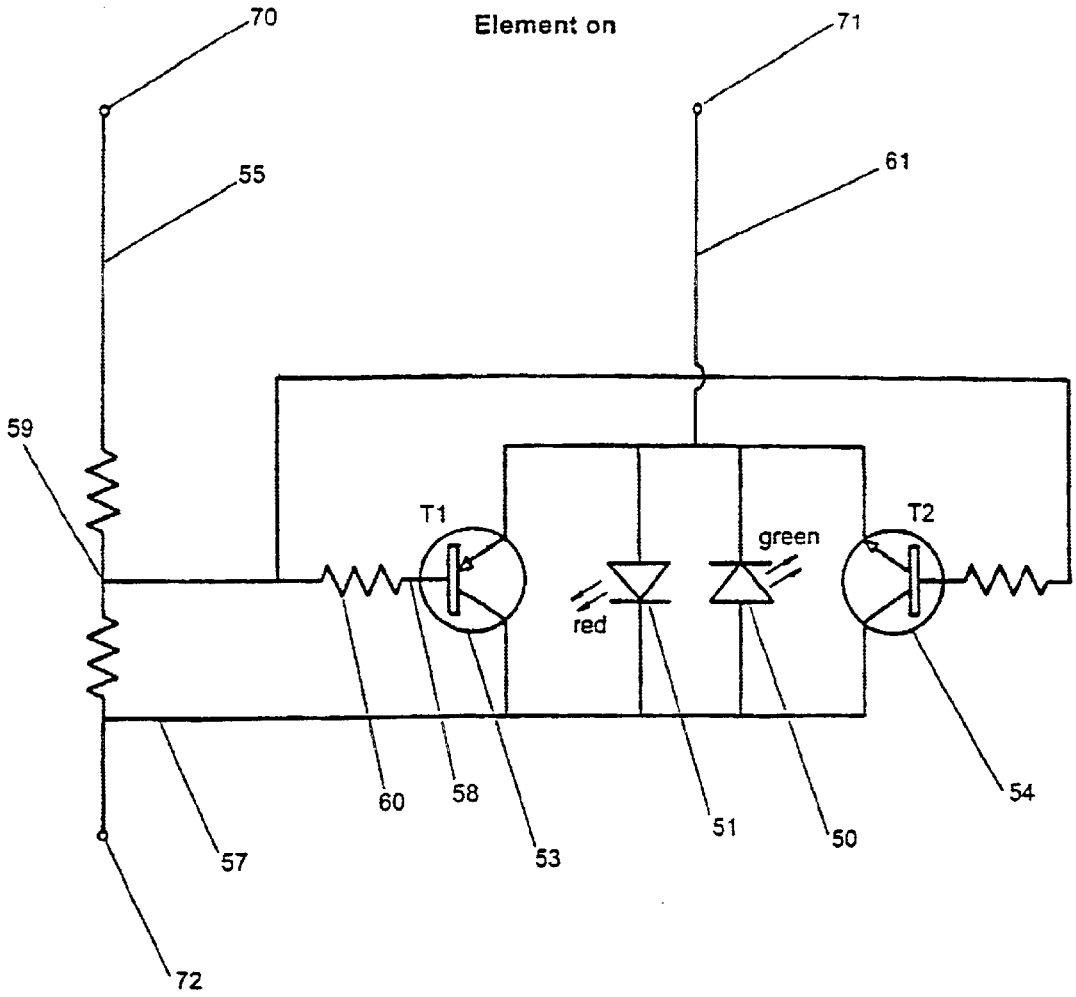
FIG. 6 is an equivalent circuit with the element on, FIG. 7 is an equivalent circuit with the element cooling.

Firstly in the element on configuration, shown in equivalent form in FIG. 6, the element switch 52 is in an closed state. This effectively ties the base of (pnp) T1 53 and (npn) T2 54 to the phase rail 55. The maximum emitter to collector voltage of T1 53 is clamped to a maximum of the on state voltage of the red LED 51 during the positive half of the phase voltage, which is approximately 1.5V. Thus for T1 53 to be in an on state the base voltage 58 must be lower than 0.9V. The actual voltage 59 driving the base from the voltage divider must be slightly lower than 0.9V to account for the voltage drop across the base resistor 60. The voltage divider voltage 59 is designed such that relative to the collector voltage 61 T1 53 is prevented from attaining the necessary base to emitter voltage to turn on. The mirror of this applies for T2 54 and the green LED 50 during the negative half cycle.

This means during the positive half cycle the red LED 51 will be on and in the negative half cycle the green LED 50 will be on. This cycling of green and red at 50 Hz will appear to the human eye as orange light.

Figure 7:
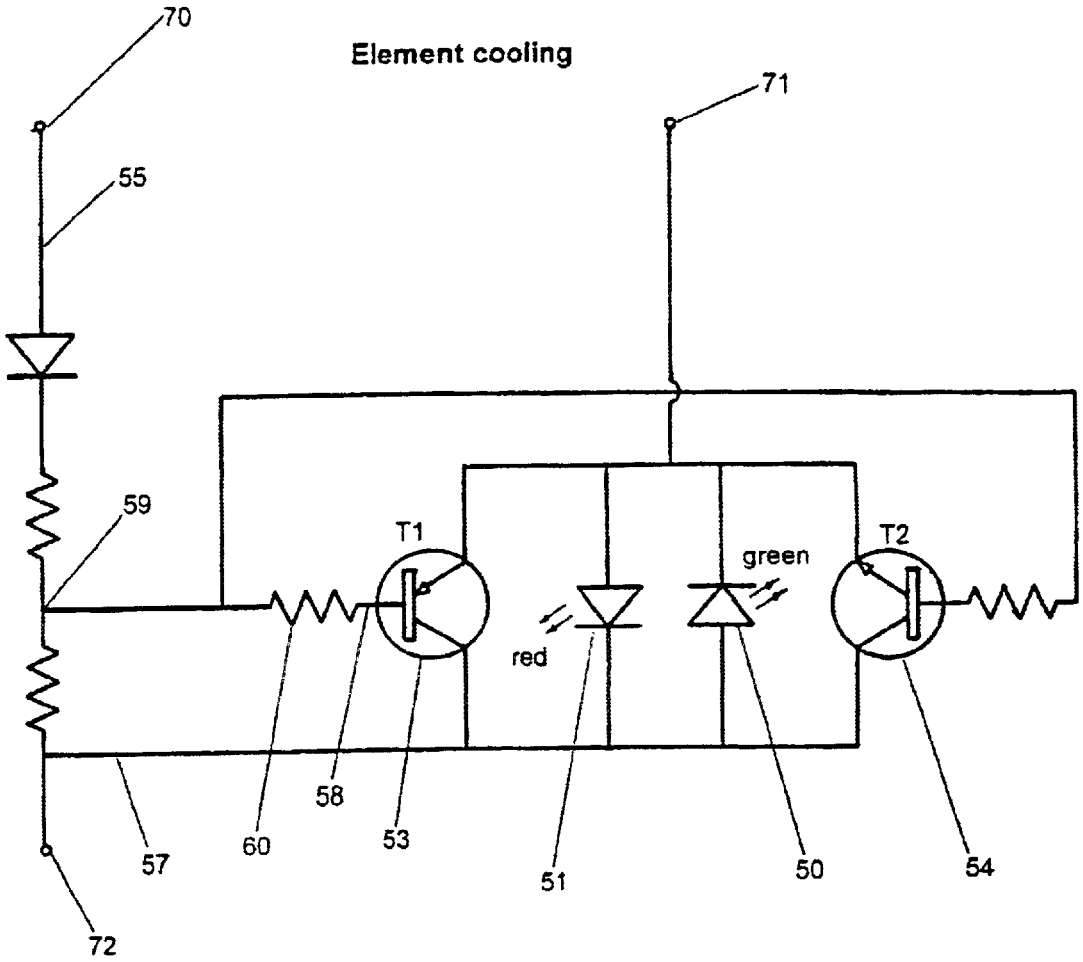

When the element is cooling (temperature above 50° C.) the bimetallic switch 56 is in a closed state and the element switch 52 is in an open state, shown in equivalent form in FIG. 7. This effectively ties the base of T1 53 and T2 54 to the phase rail 55 in the positive half cycle and to the reference rail 57 in the negative half cycle. This means that during the positive half cycle T1 53 will biased off allowing the red LED 51 to be on. During the negative half cycle T2 54 will be biased on which bypasses the green LED 50. Therefore with only the red LED allowed to operate the human eye will see red light.

Figure 8:
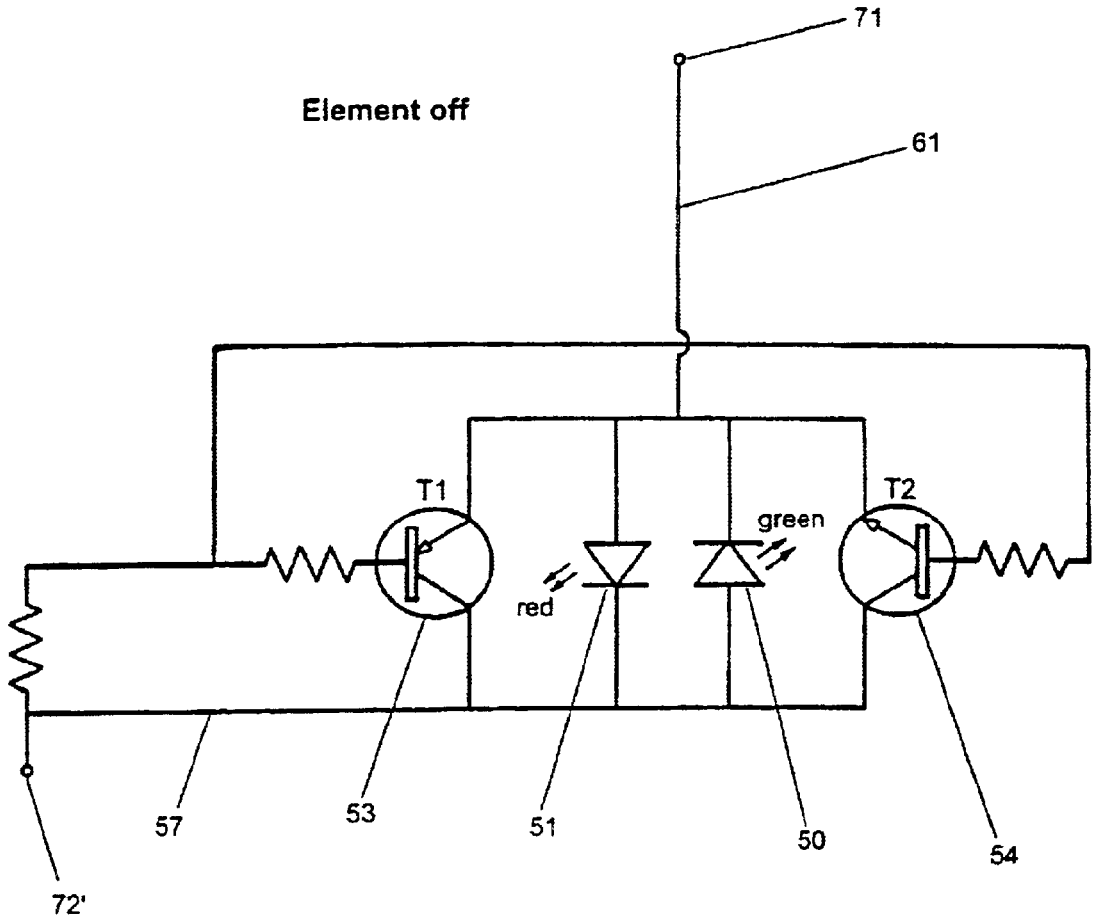
FIG. 8 is an equivalent circuit with the element off.

Finally in the element off configuration, shown in equivalent form in FIG. 8, the element switch 52 and the bimetallic switch 56 are in an open state. This effectively ties the base of T1 53 and T2 54 to the reference rail 57. This means that T1 53 will be biased on in the positive half cycle and T2 54 will be biased on in the negative half cycle. Thus for both half cycles the LEDs will be bypassed and therefore the operator will see no light.

Equally applicable would be the use of a thermistor with an electronic controller to calculate the surface temperature and activate the LED at the appropriate times. Similarly a timer based system whereby the LED is kept on for a "typical time to cool" might also be used to control the LED.

Figure 9:
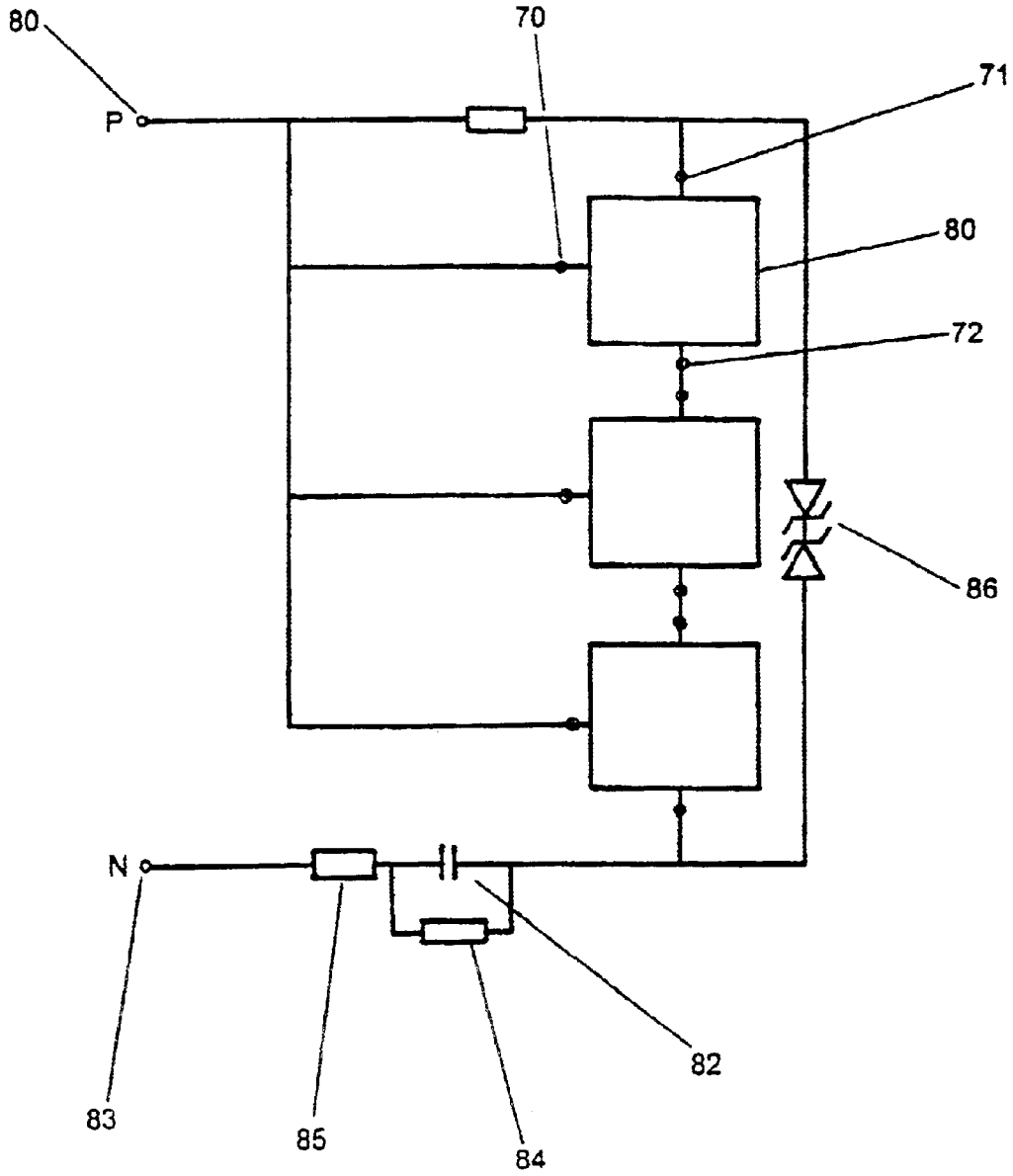
FIG. 9 is a circuit diagram of the complete circuit.

In the preferred embodiment a number of such modules will be connected together in series and connected to a power supply. In one embodiment, shown in FIG. 9, three such modules 80 are connected as such in respect of a three element cooktop. Each module is connected with its reference terminal 72 connected to the corresponding supply terminal 71 of the preceding module—these correspond to the reference rail and collector voltage referred to in the description of each module. Also a connection 70 to the phase terminal 81 of the supply is used in each module to supply the switches 52, 56.

The supply itself is of the transformer less variety, instead utilising a capacitor to ensure a constant current supply. In the preferred embodiment, again referring to FIG. 9, a single capacitor 82 is connected in series in the neutral rail 83 with safety resistor 84, and surge resistor 85 for this purpose. Two further zener diodes 86 are connected in parallel across the supply for transient over voltage protection.

We claim:

1. A cook top comprising:

at least one heating means beneath a substantially colourless and transparent ceramic glass surface with an opaque layer on sections of the underside thereof; and a status indicator including indication means positioned directly underneath said surface and proximate to said surface wherein said opaque layer is not present directly above said indication means, allowing said indication means to be visible directly above said cook top, and a control means configured to determine the temperature of said surface above said heating means and energise said indication means when said surface above said heating means is above a predetermined temperature and de-energises said indication means when said surface above said heating means is below said predetermined temperature.

2. A cook top according to claim 1 wherein said control means comprises an electric circuit fed from a transformer less supply.

3. A cook top according to claim 1 wherein the colour emitted by said indication means is dependent on whether said heating means is energised.

4. A cook top according to claim 1 wherein said indication means is at least one light emitting diode.

5. A cook top according to claim 1 wherein said control means includes heat sensing means positioned in close proximity to said heating means, the electrical characteristics of which are temperature dependent.

6. A cook top according to claim 5 wherein said heat sensing means is a bimetallic switch.

7. A cook top according to claim 5 wherein said heating sensing means is a thermistor.

8. A cook top according to claim 5 wherein said heating sensing means is a positive temperature coefficient paste coated on the underside of said surface or said opaque layer.

9. A cook top according to any one of claims 1 to 8 wherein said predetermined temperature is the maximum temperature for which human skin can safely be exposed to.

10. A cook top according to claim 9 wherein said maximum temperature is 50° C.

* * * * *

UNITED STATES PATENT AND TRADEMARK OFFICE

CERTIFICATE OF CORRECTION

PATENT NO. : 6,794,621 B1
APPLICATION NO. : 10/030863
DATED : September 21, 2004
INVENTOR(S) : Simon Denzil Brown and Graeme Colin Fuller It is certified that error appears in the above-identified patent and that said Letters Patent is hereby corrected as shown below:

On title page Please insert the following:

Item (56) References Cited

U.S. PATENT DOCUMENTS

| | | |
|---|---|---|
| --3,612,826 | 10/71 | Deaton |
| 4,242,304 | 12/80 | Ryder -- |

Column 3, Line 16, "(the ability to t radiant" should be -- (the ability to transmit radiant --

Signed and Sealed this

Twentieth Day of March, 2007

JON W. DUDAS
*Director of the United States Patent and Trademark Office*